US007640701B2

(12) United States Patent
Rutherford

(10) Patent No.: US 7,640,701 B2
(45) Date of Patent: Jan. 5, 2010

(54) DEFLECTION CLIP

(75) Inventor: Barry Rutherford, Chatsworth, CA (US)

(73) Assignee: Flannery Inc., San Fernando, CA (US)

( * ) Notice: Subject to any disclaimer, the term of this patent is extended or adjusted under 35 U.S.C. 154(b) by 142 days.

(21) Appl. No.: 11/595,907

(22) Filed: Nov. 10, 2006

(65) Prior Publication Data

US 2008/0110113 A1 May 15, 2008

(51) Int. Cl.
*E04B 1/41* (2006.01)

(52) U.S. Cl. ..... 52/243; 52/242; 52/715; 52/656.9; 52/655.1; 52/489.1

(58) Field of Classification Search ..... 52/712, 52/715, 702, 241, 285.1, 285.3, 655.1, 656.9, 52/243.1, 481.1, 481.2, 489.1, 714, 242; 402/404; 24/545; 403/404, 187
See application file for complete search history.

(56) References Cited

U.S. PATENT DOCUMENTS

| | | | | | |
|---|---|---|---|---|---|
| 529,154 | A | * | 11/1894 | Banks | 52/243 |
| 656,274 | A | * | 8/1900 | Streeter | 403/387 |
| 718,545 | A | * | 1/1903 | Streeter | 403/188 |
| 1,530,180 | A | * | 3/1925 | Holmes | 211/65 |
| 2,041,773 | A | * | 5/1936 | Manske | 52/346 |
| 2,074,475 | A | * | 3/1937 | Manske | 292/258 |
| 2,236,258 | A | * | 3/1941 | Burson | 52/285.3 |
| 2,258,574 | A | * | 10/1941 | Leary | 52/362 |
| 2,296,609 | A | * | 9/1942 | Gibson et al. | 52/357 |
| 2,350,093 | A | * | 5/1944 | Braloff | 52/241 |
| 2,368,620 | A | * | 2/1945 | Strom | 52/242 |
| 2,936,049 | A | * | 5/1960 | Hovind | 403/217 |
| 3,195,191 | A | * | 7/1965 | Neisewander | 52/243.1 |
| 3,204,288 | A | * | 9/1965 | Adams | 16/268 |
| 3,232,018 | A | * | 2/1966 | MacKean | 52/346 |

(Continued)

FOREIGN PATENT DOCUMENTS

JP 2001-020421 1/2001

(Continued)

OTHER PUBLICATIONS

Patent Abstracts of Japan for Publication No. 2001-020421; Date of Publication of Application Jan. 23, 2001 in the name of Mark J. Pfaller et al.

(Continued)

*Primary Examiner*—Phi D. A
(74) *Attorney, Agent, or Firm*—Christie, Parker & Hale, LLP

(57) ABSTRACT

A deflection clip for erection of partitions in office space and commercial use is disclosed. A deflection clip in accordance with the present invention has a flat base with a left and right clasp that are substantially parallel to the base. The right and left clasps are used to secure the deflection clip to a leg of an open channel track attached to the floor and ceiling. The left and right clasp each have a left and right stud extension tab extending substantially perpendicular from an inside edge of the left and right clasps. The left and right stud extension tabs are used to secure a stud in relation to the open channel track, allowing the ceiling and floor to deflect relative to each other without transferring load to the stud.

12 Claims, 3 Drawing Sheets

U.S. PATENT DOCUMENTS

| | | | | | |
|---|---|---|---|---|---|
| 3,332,188 | A | * | 7/1967 | Schaefer | 52/349 |
| 3,358,411 | A | * | 12/1967 | Birum, Jr. | 52/241 |
| 3,862,535 | A | * | 1/1975 | Byssing | 52/714 |
| 3,881,293 | A | * | 5/1975 | Conville | 52/712 |
| 3,961,835 | A | * | 6/1976 | Huang et al. | 439/828 |
| 4,018,020 | A | | 4/1977 | Sauer et al. | |
| 4,068,432 | A | * | 1/1978 | Davis | 52/205 |
| 4,074,860 | A | * | 2/1978 | Rex | 238/349 |
| 4,307,976 | A | * | 12/1981 | Butler | 405/118 |
| 4,377,060 | A | * | 3/1983 | Ragland | 52/489.2 |
| 4,452,027 | A | * | 6/1984 | Desai | 52/712 |
| 4,452,360 | A | * | 6/1984 | Barnes | 211/59.1 |
| 4,745,665 | A | * | 5/1988 | Hilsenbeck | 24/295 |
| 4,870,794 | A | | 10/1989 | Menchetti | |
| 4,908,915 | A | | 3/1990 | Ruggles et al. | |
| 5,040,345 | A | | 8/1991 | Gilmour | |
| 5,152,117 | A | * | 10/1992 | Wynar | 52/712 |
| 5,224,322 | A | | 7/1993 | van den Toorn | |
| 5,408,796 | A | * | 4/1995 | Hashimoto et al. | 52/489.2 |
| 5,555,689 | A | * | 9/1996 | Gilmore | 52/489.1 |
| 5,566,513 | A | * | 10/1996 | Herren | 52/12 |
| 5,590,502 | A | * | 1/1997 | Wendt | 52/489.2 |
| 5,664,392 | A | * | 9/1997 | Mucha | 52/715 |
| 5,671,580 | A | * | 9/1997 | Chou | 52/656.4 |
| 5,678,797 | A | * | 10/1997 | Gogan | 248/251 |
| 5,685,121 | A | | 11/1997 | DeFrancesco et al. | |
| 5,720,571 | A | | 2/1998 | Frobosilo et al. | |
| 5,836,133 | A | | 11/1998 | Bergeron et al. | |
| 5,846,018 | A | * | 12/1998 | Frobosilo et al. | 403/403 |
| 5,904,023 | A | | 5/1999 | diGirolamo et al. | |
| 5,927,037 | A | * | 7/1999 | Kinsella | 52/506.05 |
| 5,966,893 | A | | 10/1999 | Quillin | |
| 6,000,181 | A | | 12/1999 | Wheeler | |
| 6,082,065 | A | * | 7/2000 | Feldpausch | 52/239 |
| 6,213,679 | B1 | * | 4/2001 | Frobosilo et al. | 403/403 |
| 6,499,198 | B2 | * | 12/2002 | Eckenrode | 24/295 |
| D473,124 | S | * | 4/2003 | Wu et al. | D8/356 |
| 6,668,510 | B2 | | 12/2003 | McManus | |
| 6,688,069 | B2 | | 2/2004 | Zadeh | |
| 6,729,585 | B2 | * | 5/2004 | Ogden | 248/58 |
| 6,792,733 | B2 | * | 9/2004 | Wheeler et al. | 52/656.1 |
| 6,799,407 | B2 | | 10/2004 | Saldana | |
| 2002/0046525 | A1 | * | 4/2002 | Rice | 52/481.1 |
| 2002/0170260 | A1 | | 11/2002 | Wheeler et al. | |
| 2003/0126820 | A1 | * | 7/2003 | Callahan et al. | 52/514 |
| 2003/0126823 | A1 | | 7/2003 | McManus | |
| 2003/0196401 | A1 | | 10/2003 | Surowiecki | |
| 2004/0074198 | A1 | | 4/2004 | Saldana | |
| 2005/0060850 | A1 | * | 3/2005 | Auriemma | 24/545 |
| 2005/0252154 | A1 | * | 11/2005 | Martel et al. | 52/712 |
| 2005/0271492 | A1 | * | 12/2005 | Jackson et al. | 411/112 |
| 2008/0053015 | A1 | * | 3/2008 | Matechuk | 52/235 |
| 2008/0053034 | A1 | * | 3/2008 | Matechuk et al. | 52/702 |
| 2008/0072526 | A1 | * | 3/2008 | Becker et al. | 52/712 |

FOREIGN PATENT DOCUMENTS

| | | |
|---|---|---|
| WO | WO 98/15697 | 4/1998 |
| WO | WO 03/040486 A1 | 5/2003 |

OTHER PUBLICATIONS

Cover page entitled "Snap Trak", manufactured by Total Steel TSS Solutions, Kimball, MN (with webpages from www.totalsteel.biz), 3 pgs.

Cover page entitled "rediklip", Total Steel TSS Solutions (with webpages from www.firetrak.com), 3 pgs.

Cover page from www.steelnetwork.com entitled "VertiTrack® VTD Pre-Assembled Interior Head of Wall", p. 6.

Cover page from www.steelnetwork.com entitled "VertiClip® SLD Interior Head of Wall", p. 4.

Cover page entitled "Fumble Proof Clips" by Flex-Ability Concepts, 1 page.

Cover page entitled "Snap Trak Deflection Track for Related and Non-Related Walls", 1 page.

Cover page entitled "The Proven Solution Sliptrack Systems, Inc. Cyclical Design", marketed by: The Donovan Company, Inc., Anaheim, CA, 1 page.

* cited by examiner

DEFLECTION CLIP

FIELD OF THE INVENTION

The present invention relates in general to deflection clips used in construction, and in particular to a deflection clip used in interior construction to secure a stud between a floor track and ceiling track for offices and commercial space.

BACKGROUND OF THE INVENTION

In present day architecture most large buildings utilize a support structure framework comprising vertical metal studs with horizontal metal beams and metal decking at the ceilings and steel beams, metal decking and concrete at the floors. The support structure of vertical metal studs in the framing of a building are connected directly to metal decking and beams that run along the floor and ceiling. The vertical studs and horizontal beams and decking are frequently rigidly secured to each other by fasteners in a manner that allows little, if any, vertical displacement of the floor and ceiling. This support structure is covered with an exterior finish usually made up of gypsum panels or wall partitions.

While the floors and roof of the support structure are designed to bear a calculated maximum load, they also must be permitted to compensate for differential loads. Differential loads, such as those due to weight applied to the floors and roof change frequently. The floors and ceiling must be designed to withstand such deflections but the walls should be isolated from such movement to prevent damage which would otherwise result from the compressive forces generated by the movement due to the loads.

The fixed relationship of non-load bearing studs and floor and ceiling systems present serious problems for office floors bearing heavy loads, or in those parts of the country that receive heavy snow fall. For instance, a heavy load of snow can cause a downward pressure on the vertical non-bearing studs which have attached various wall coverings. The result was that the vertical pressure would cause unsightly and costly cracks in the wall coverings and generally weaken the wall beneath the structure because there was not a way to alleviate the downward pressure. In addition, in areas where there are exceedingly hot days such as in the desert and metal framing studs are used, roofs have a tendency to expand. With such expansion the roofs have no flexibility and upward movement will also cause the wall coverings to crack.

In the case of office and other types of building occupancies, it is commonly known that the floor system is differentially loaded at different times during the day or night. This loading is caused primarily by people and/or equipment. An example would be the office floor system that is loaded by people during work hours, at which time a larger downward pressure is being exerted on the non-bearing walls below. During the times in which the floor does not support extra loading, the floor system moves upward and away from the non-bearing walls.

Deflection clips have been utilized in interior construction for the erection of partitions in office and commercial spaces. In the typical set-up, there is a floor track which is an upward opening channel on the floor and an overhead ceiling track which is a downwardly opening track on the ceiling. Metal studs are inserted into the track at specified spacings. The studs are attached or secured to the tracks with various types of attachments which are generally referred to as deflection clips.

In the prior art, various deflection clips have been suggested. For example, L-shaped plates or clips have been used in the past which include a simple angle clip having a leg welded to a building support. The L-shaped plates or clips further include a side having an elongated slot to receive a bolt or screw to secure it to a C-shaped stud member. A difficulty with this bolt or screw is that it requires a permanent attachment of the clip or L shaped plate to an exterior C shaped channeled stud. Such attachment does not compensate for building floors sagging under heavy loads. It can be seen, then, that there is a need for a deflection clip that attaches the stud to the floor and ceiling track allowing for differential loads.

SUMMARY OF THE INVENTION

To minimize the limitations in the prior art, and to minimize other limitations that will become apparent upon reading and understanding the present specification, the present invention discloses a deflection clip for use in erection of interior partitions. The deflection clip has a base that is substantially flat and substantially rectangular shaped. The rectangle shape has a perimeter made up of two short edges, a first long edge, and a second long edge. The base has an outside surface, an inside surface, a left end portion, and a right end portion. The outside and inside surfaces are on opposite sides of each other and the left and right end portions divide the base in half. Substantially flat, a left clasp extends downwardly from the first long edge and overlaps the left end portion. The left clasp is integrally formed with the first long edge and is substantially parallel to the base. The left clasp has an integrally formed tab portion extending substantially perpendicular to the clip and the base and substantially parallel to the short edges of the base. Substantially flat, a right clasp extends downwardly from the first long edge and overlaps the right end portion. The right clasp is integrally formed with the first long edge and is substantially parallel to the base. The right clasp has an integrally formed tab portion extending substantially perpendicular to the clip and the base and substantially parallel to the short edges of the base.

The deflection clip secures a stud positioned between open channel tracks which are affixed to the floor and ceiling. The open channel tracks are C shaped with a base and two legs extending perpendicular to the base. The C shaped open channel track allows a stud to be placed therein. The stud rests in the base of the floor track and is short of touching the base of the ceiling track by about 0.75 inches. The leg of each open channel track is about 2.5 inches long, so at the ceiling there is about 1.75 inches of overlap between the stud and the leg of the ceiling track. The 0.75 inch gap allows the ceiling to move up and down without transferring loads to the stud. The deflection clip secures the stud from moving along the longitudinal length of the open channel tracks. The deflection clip is attached to the leg of an open channel track by sliding the deflection clip over the leg with the stud positioned between tabs of the right and left clasps. The right and left clasps of the deflection clip engage the leg of the open channel track. Therefore, the deflection clip secures the stud between the tabs of the right and left clasps allowing the stud to ride up and down within the open channel tracks as the ceiling and floor deflects relative to each other.

In one embodiment, the deflection clip is made from spring steel that is sufficiently resilient allowing the clip to be simply tapped into place. This eliminates the requirement for fasteners to secure the clip in place. Eliminating the use of fasteners helps to eliminate a drywall bulge created by a screw attachment to the stud. The deflection clip may be used in either the floor or ceiling track. The deflection clip allows both sides of the stud to be secured from one side. In another embodiment, the deflection clip can be cut in half to secure a stud at an inside corner.

BRIEF DESCRIPTION OF THE DRAWINGS

Referring now to the drawings in which like numbers represent corresponding parts throughout.

DETAILED DESCRIPTION OF THE INVENTION

In the following description of the preferred embodiment, reference is made to the accompanying drawings that form a part thereof, in which are shown by way of illustration specific embodiments in which the invention may be practiced. It is to be understood that other embodiments may be utilized and structural changes may be made without departing from the scope of the present invention.

Figure 1:
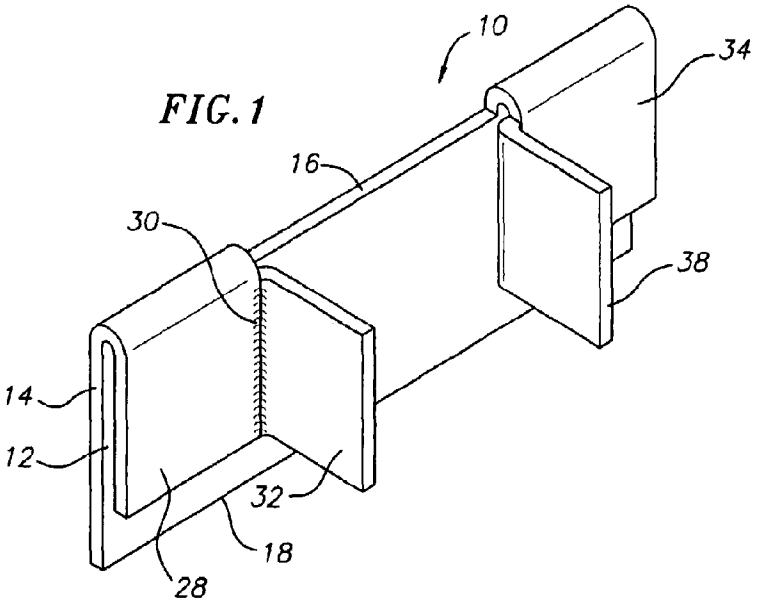
FIG. 1 is an isometric view of one embodiment of the present invention.
Figure 2:
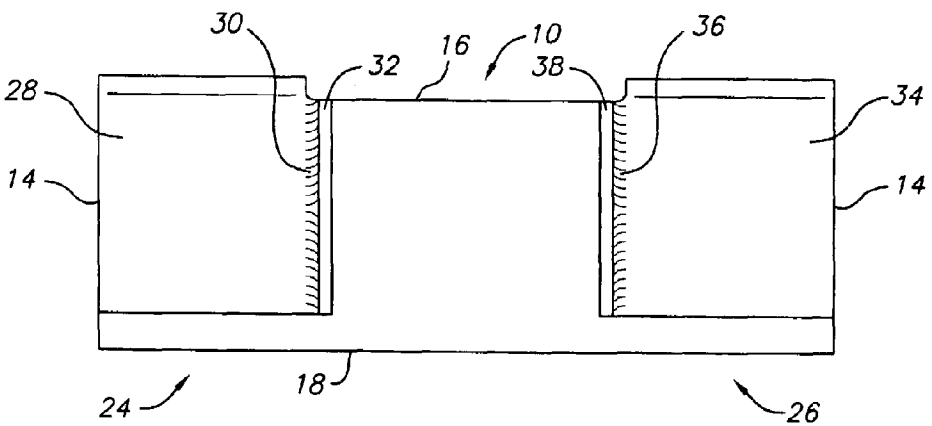
FIG. 2 is a front view of the embodiment of FIG. 1.
Figure 3:
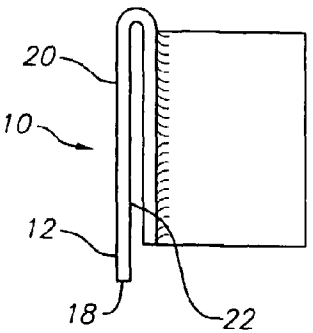
FIG. 3 is a side view of the embodiment of FIG. 1.
Figure 4:
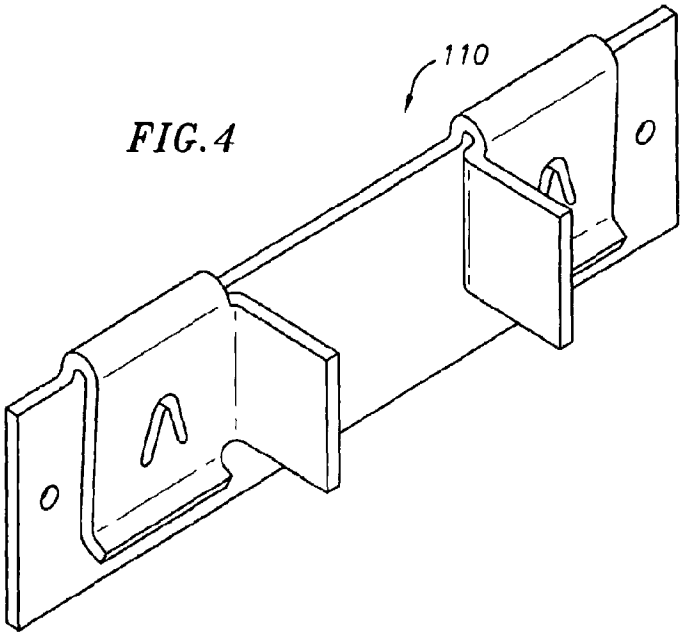
FIG. 4 is an isometric view of another embodiment of the present invention.
Figure 5:
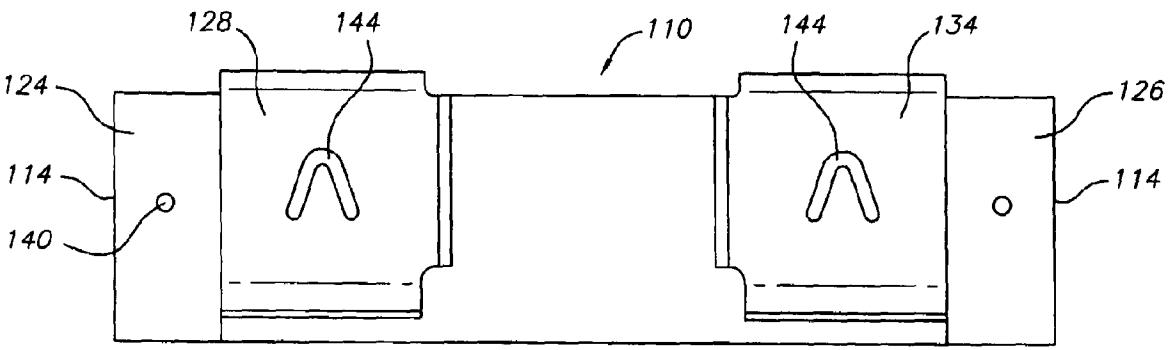
FIG. 5 is a front view of the embodiment of FIG. 4.
Figure 6:
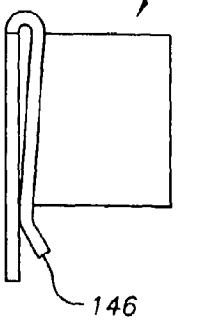
FIG. 6 is a side view of the embodiment of FIG. 4.

Referring now to FIGS. 1-3, a deflection clip 10 for erection of partitions is shown. The deflection clip 10 has a base 12 that is substantially flat and substantially rectangular shaped. The rectangle shape has a perimeter made up of two short edges 14, a first long edge 16, and a second long edge 18. The base 12 has an outside surface 20, an inside surface 22, a left end portion 24, and a right end portion 26. The outside surface 20 and inside surface 22 are opposite each other and the left end portion 24 and right end portions 26 each comprise approximately one half of the deflection clip structure. A left clasp 28 is substantially flat and extends downwardly from the first long edge 16. The left clasp 28 is bent substantially about the first long edge 16 towards the inside surface 22 so that the left clasp 28 overlaps and is substantially parallel to the base 12. The left clasp 16 defines a left clasp inside angle 30 in a direction substantially perpendicular to the first long edge 16. Substantially flat, a left stud extension tab 32 extends outwardly from the left clasp inside corner 30. The left stud extension tab 32 extends from the left clasp inside angle 30 outwardly away from inside surface 22 so that the left stud extension tab 32 is substantially perpendicular to the inside surface 22 of the base 12 and substantially parallel to the short edge 14 of the base 12. A right clasp 34 is substantially flat and extends downwardly from the first long edge 16. The right clasp 34 is bent substantially about the first long edge 16 towards the inside surface 22 so that the right clasp 34 overlaps and is substantially parallel to the base 12. The right clasp 34 has a right clasp inside angle 36 in a direction substantially perpendicular to the first long edge 16. Substantially flat, a right stud extension tab 38 extends outwardly from the right clasp inside corner 36. The right stud extension tab 38 extends from the right clasp inside angle 36 outwardly away from the inside surface 22 so that the right stud extension tab 38 is substantially perpendicular to the inside surface 22 of the base 12 and substantially parallel to the short edge 14 of the base 12.

In one embodiment, the left clasp 28 and right clasp 34 are made of a resilient material such as spring steel. The resilient material allows the left clasp 28 and right clasp 34 to deflect and return back to its original shape. Therefore the deflection clip 10 can be attached to a leg of an open channel track by sliding the deflection clip 10 over the leg with the stud positioned between tabs 32 and 38. A resilient material may be spring steel, or any other suitable material that is resilient. This specification is not intended to be exhaustive or to limit the material to the specific type disclosed.

In FIGS. 3-6, another embodiment for a deflection clip 110 is shown. It can be seen that the left end portion 124 extends beyond the left clasp 128, and the right end portion 126 extends beyond the right clasp 134. A left opening 140 is located in the left end portion 124 of the base 112 near the short edge 114. A right opening 142 is located in the right end portion 126 of the base 112 near the short edge 114. This arrangement allows for a fastener to go through the left opening 140 and right opening 142 securing the deflection clip 110 to a leg of an open channel track.

In this embodiment, the left clasp 128 and right clasp 134 have a substantially arrow shaped opening 144 pointing in a direction towards the first long edge 116. This arrow shaped opening 144 is utilized to better secure the deflection clip 110 to the leg of an open channel track. Other shapes may also be used to better secure the deflection clip 110 to the leg of an open channel track, as this specification is not intended to be exhaustive or to limit the configuration of the opening to the specific type disclosed.

In this embodiment, the left clasp 128 and right clasp 134 have a slight curvature on a distal edge 146 in a direction away from the inside surface 122 thereby allowing the deflection clip 110 to be snugly secured to the leg of the open channel track. The deflection clip 110 may be made from one flat integral piece of material, and thereafter cut and bent into shape, or the deflection clip 110 may be manufactured in a process such as casting or molding. Many methods of manufacture are known allowing the disclosed configuration to be produced. This specification is not intended to be exhaustive or to limit the manufacturing methods to the specific type disclosed.

Figure 7:
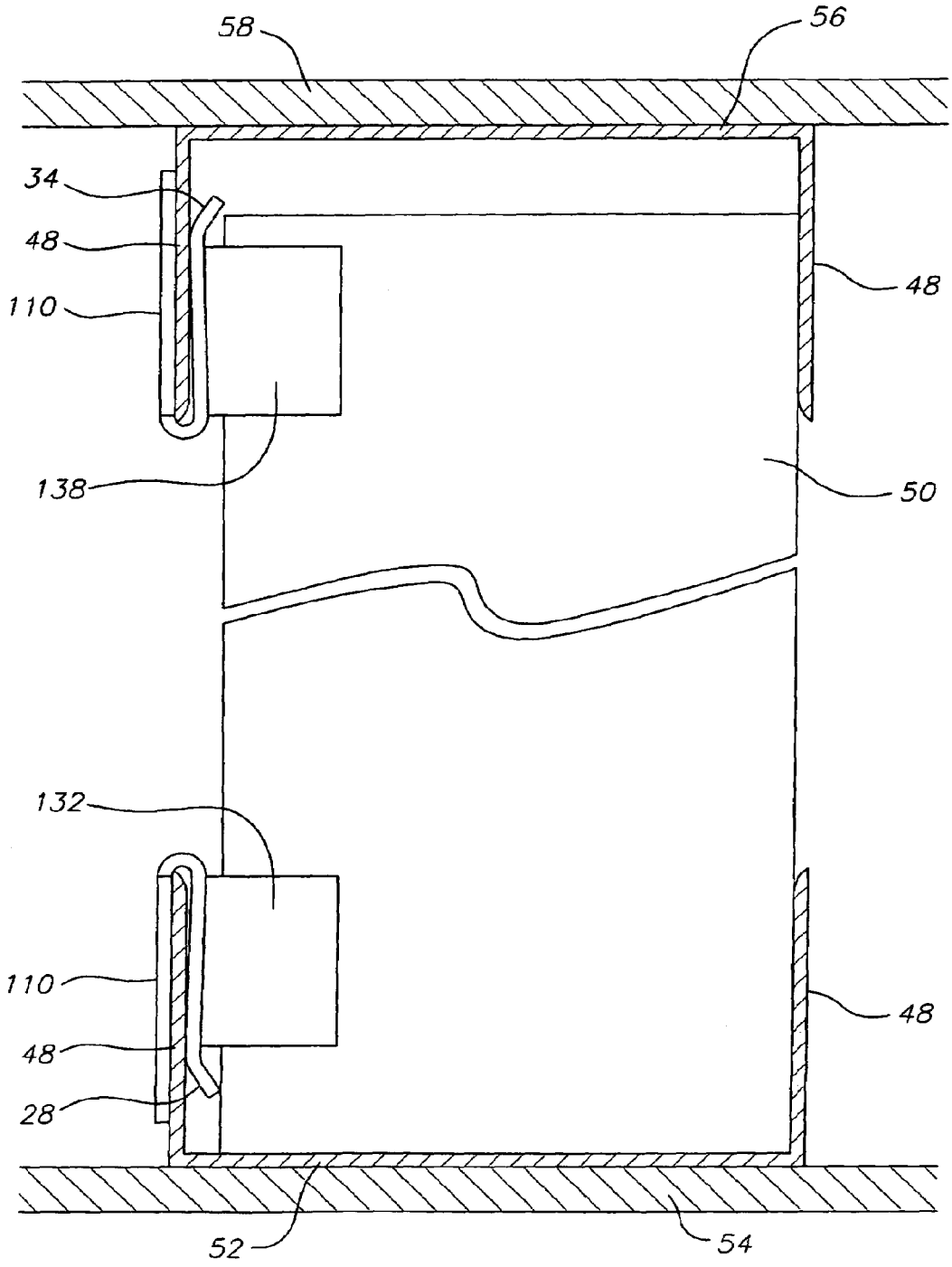
FIG. 7 is a side view of the embodiment of FIG. 4 with a floor track and ceiling track in cross-section.

In FIG. 7, the deflection clip 110 is shown installed in two open channel tracks. The floor track 52 is attached to the floor 54 and the ceiling track 56 is attached to the ceiling 58. A stud 50 is placed between the floor track 52 and ceiling track 56. The deflection clip 110 is mounted on one leg 48 of each open channel track. The deflection clip 110 can be positioned against the side of the stud 50 and slid into place onto the upwardly extending leg 48 of the floor track 52 and the ceiling track 56. When the deflection clip 110 is inserted into the space between the stud 50 and the track, the left and right clasps 28 & 34 snuggly wedge into the space thereby securing the stud 50 in position. As shown at the floor track 52, the deflection clip 110 secures the stud 50 between the left stud extension tab 132 and the right stud extension tab 138 (not shown). As shown at the ceiling track 56, the deflection clip 110 secures the stud 50 between the left stud extension tab 132 (not shown) and the right stud extension tab 138. The left stud extension tab 132 and the right stud extension tab 138 act as a bracket for the stud 50 to fit between. The stud 50 is held in position and prevented from moving along the longitudinal length of the track. The deflection clip 110 may be utilized at any position along the longitudinal length of the track. In one embodiment stud 50 is made of an appropriate length to create about a 0.75 inch gap between the top of the stud 50 and the base of the ceiling track 56 when the stud is placed in the floor track. The leg 48 of each open channel track is about 2.5 inches long, so at the ceiling there is about 1.75 inches of overlap between the stud 50 and the leg 48 of the ceiling track

56. The 0.75 inch gap allows the ceiling to move up and down without transferring loads to the stud 50.

The deflection clip 110 allows for the elimination of the requirement for fasteners. The deflection clip 110 can be simply tapped into place. Due to the elimination of fasteners, a dry wall bulge can be eliminated which usually results from the protrusion of fastener heads into the backside of dry wall partitions mounted on the studs. When used with studs at room corners, the deflection clip 110 is cut in half and used to secure the stud 50 in a corner location.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A track, stud and deflection clip combination for building construction, comprising:

a track adjacent a floor or ceiling of a building;

a stud mounted on said track; and a deflection clip comprising, a flat base substantially comprised of an outside surface opposite an inside surface joined by a perimeter comprised of a first edge, a left clasp substantially flat and parallel to the flat base extending from and bending about the first edge, said left clasp overlying a portion of the base, a left stud extension tab substantially flat and perpendicular to the left clasp and flat base extending upwardly from and bending about the interior edge of the left clasp, a right clasp substantially flat and parallel to the flat base extending from and bending about the first edge, said right clasp overlying a portion of the base, and a right stud extension tab substantially flat and perpendicular to the right clasp and flat base extending upwardly from and bending about the interior edge of the right clasp;

wherein at least a portion of the track is sandwiched by at least one of said left and right clasps and the base, and wherein the stud is adjacent at least one of said left and right stud extension tabs.

2. The combination of claim 1, wherein the left and right clasps are sufficiently resilient, thereby allowing the deflection clip base and clasps to straddle and grip the track.

3. The combination of claim 2, wherein the deflection clip is made from spring steel.

4. The combination of claim 3, further including a first opening located proximate a first end of the base between the left clasp and the first end and further including a second opening located proximate a second end of the base between the right clasp and the second end.

5. The combination of claim 4, wherein the left clasp does not extend over the first opening and wherein the right clasp does not extend over the second opening, thereby allowing a fastener to be utilized to further secure the deflection clip to a leg of the track.

6. The combination of claim 5, wherein the left and right clasps have a substantially arrow shaped opening pointing in a direction perpendicular to the longitudinal axis of the base member.

7. The combination of claim 6, wherein the left and right clasps have a slight bend on a distal edge in a direction away from the top side thereby allowing the deflection clip to be easily secured to the track.

8. The combination of claim 6, wherein the deflection clip is manufactured from one flat integral piece of material cut and bent into shape.

9. The combination of claim 1, wherein the left and right stud extension tabs are substantially perpendicular to the first edge separated by a gap receiving the stud, thereby capturing the stud between the left and right stud extension tabs.

10. The combination of claim 9, wherein the left and right clasps have a slight bend on a distal edge in a direction away from the inside surface thereby allowing the deflection clip to be easily secured to a leg of an open channel of the track.

11. The combination of claim 10, wherein the deflection clip is made of a material sufficiently resilient.

12. The combination of claim 11, wherein the sufficiently resilient material is spring steel.

* * * * *